US011253753B2

(12) United States Patent
Carter

(10) Patent No.: US 11,253,753 B2
(45) Date of Patent: Feb. 22, 2022

(54) TENNIS RACKET WITH A MORE-RESPONSIVE STRING CONFIGURATION

(71) Applicant: Ronald B Carter, Mayfield Hts, OH (US)

(72) Inventor: Ronald B Carter, Mayfield Hts, OH (US)

( * ) Notice: Subject to any disclaimer, the term of this patent is extended or adjusted under 35 U.S.C. 154(b) by 0 days.

(21) Appl. No.: 15/788,796

(22) Filed: Oct. 19, 2017

(65) Prior Publication Data

US 2018/0104546 A1 Apr. 19, 2018

Related U.S. Application Data

(60) Provisional application No. 62/409,950, filed on Oct. 19, 2016.

(51) Int. Cl.

| | |
|---|---|
| ***A63B 51/02*** | (2015.01) |
| ***A63B 49/028*** | (2015.01) |
| ***A63B 49/025*** | (2015.01) |
| ***D02G 3/44*** | (2006.01) |
| *A63B 49/022* | (2015.01) |
| *A63B 49/08* | (2015.01) |
| *A63B 51/10* | (2015.01) |

(52) U.S. Cl.

CPC ..... *A63B 49/028* (2015.10); *A63B 49/025* (2015.10); *A63B 51/02* (2013.01); *D02G 3/444* (2013.01); *A63B 49/022* (2015.10); *A63B 49/08* (2013.01); *A63B 51/10* (2013.01); *A63B 2209/00* (2013.01)

(58) Field of Classification Search

CPC ..... A63B 49/025; A63B 49/028; A63B 49/08; A63B 51/00; A63B 2051/004; A63B 51/02; A63B 49/022; A63B 51/10; A63B 2209/00; D02G 3/444

See application file for complete search history.

(56) References Cited

U.S. PATENT DOCUMENTS

| | | | | |
|---|---|---|---|---|
| 1,132,214 A * | 3/1915 | Ries et al. | ..... | A63B 51/02 473/543 |
| 2,401,291 A * | 5/1946 | Smith | ..... | A63B 51/02 124/90 |
| 4,093,220 A * | 6/1978 | Prewarski | ..... | A63B 51/00 473/543 |
| 4,140,316 A * | 2/1979 | Coupar | ..... | A63B 51/14 473/540 |

(Continued)

*Primary Examiner* — Raleigh W Chiu

(74) *Attorney, Agent, or Firm* — Price & Adams, P.C.

(57) ABSTRACT

A tennis racket with a more-responsive string configuration is an apparatus that allows a user to hit a tennis ball with spin and power in a controlled manner. The apparatus includes a closed-shape beam, a throat, an elongated handle, and a plurality of lines. The elongated handle allows the user to firmly grasp the apparatus, and the throat connects the elongated handle to the closed-shape beam. The plurality of lines is tensionably mounted within the closed-shape beam in order to provide the present invention with an elastic contact area for the tennis ball. Each of the plurality of lines includes a first string and a second string, which are positioned along each other for each of the plurality of lines. In addition, a lateral surface of the first string is positioned tangent to a lateral surface of the second string.

20 Claims, 7 Drawing Sheets

(56) References Cited

U.S. PATENT DOCUMENTS 4,190,249 A * 2/1980 Fischer ..... A63B 51/06 473/533
4,231,575 A * 11/1980 Kutt ..... A63B 51/00 473/531
4,249,731 A * 2/1981 Amster ..... A63B 51/00 473/543
4,299,385 A * 11/1981 Boden ..... A63B 51/00 473/543
4,306,410 A * 12/1981 Nakamura ..... A63B 51/02 428/377
4,330,132 A * 5/1982 Ferrari ..... A63B 51/00 473/540
4,366,959 A * 1/1983 Lacoste ..... A63B 51/10 473/541
4,408,760 A * 10/1983 Ferrari ..... A63B 49/025 473/543
4,458,898 A * 7/1984 Boden ..... A63B 51/02 473/543
4,488,722 A * 12/1984 Harz ..... A63B 51/11 473/543
4,593,905 A * 6/1986 Abel ..... A63B 51/005 473/534
4,685,676 A * 8/1987 Boden ..... A63B 51/00 473/537
4,750,742 A * 6/1988 Coupar ..... A63B 49/025 473/540
5,145,172 A * 9/1992 Takashima ..... A63B 51/02 428/377
5,186,459 A * 2/1993 Korte-Jungermann ..... A63B 51/14 473/539
5,303,918 A * 4/1994 Liu ..... A63B 51/11 473/537
5,327,714 A * 7/1994 Stevens ..... A63B 51/02 273/DIG. 6
5,639,086 A * 6/1997 Wolverton ..... A63B 51/16 473/555
5,863,267 A * 1/1999 Choi ..... A63B 49/025 473/532
6,460,321 B1 * 10/2002 Koshimae ..... A63B 51/02 57/210
9,734,803 B2 * 8/2017 Klanner ..... G10D 3/10
2001/0041632 A1 * 11/2001 Bertolotti ..... A63B 51/02 473/543
2004/0005944 A1 * 1/2004 Cheng ..... A63B 51/00 473/543
2011/0020645 A1 * 1/2011 Nakanishi ..... A01K 91/00 428/359

* cited by examiner

TENNIS RACKET WITH A MORE-RESPONSIVE STRING CONFIGURATION

The current application claims a priority to the U.S. Provisional Patent application Ser. No. 62/409,950 filed on Oct. 19, 2016

FIELD OF THE INVENTION

The present invention relates generally to tennis-related sports equipment. More specifically, the present invention is a more-responsive string configuration for a tennis racket.

BACKGROUND OF THE INVENTION

Tennis strings are used in the game of tennis. Tennis strings are installed in a tennis racket by means of a tennis stringing machine. These tennis strings are under tension as the tennis racket has both main strings and cross strings. Tennis strings are interwoven into the tennis racket.

An objective of the present invention is to provide a more-responsive string configuration of a tennis racket. As the tennis ball comes into contact with tennis strings and compress, the tennis strings for the present invention spread apart and snap back together into place, which adds power and spin to the tennis ball as the tennis ball moves forward away from the tennis strings.

DETAILED DESCRIPTION OF THE INVENTION

All illustrations of the drawings are for the purpose of describing selected versions of the present invention and are not intended to limit the scope of the present invention.

Figure 1:
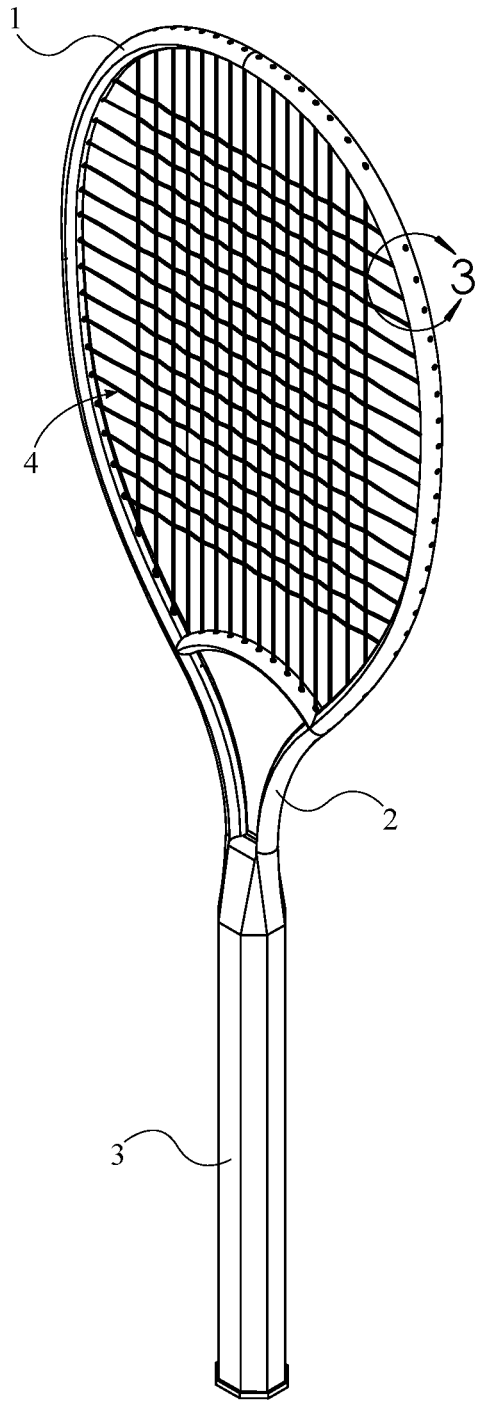
FIG. 1 is a perspective view of the present invention.
Figure 2:
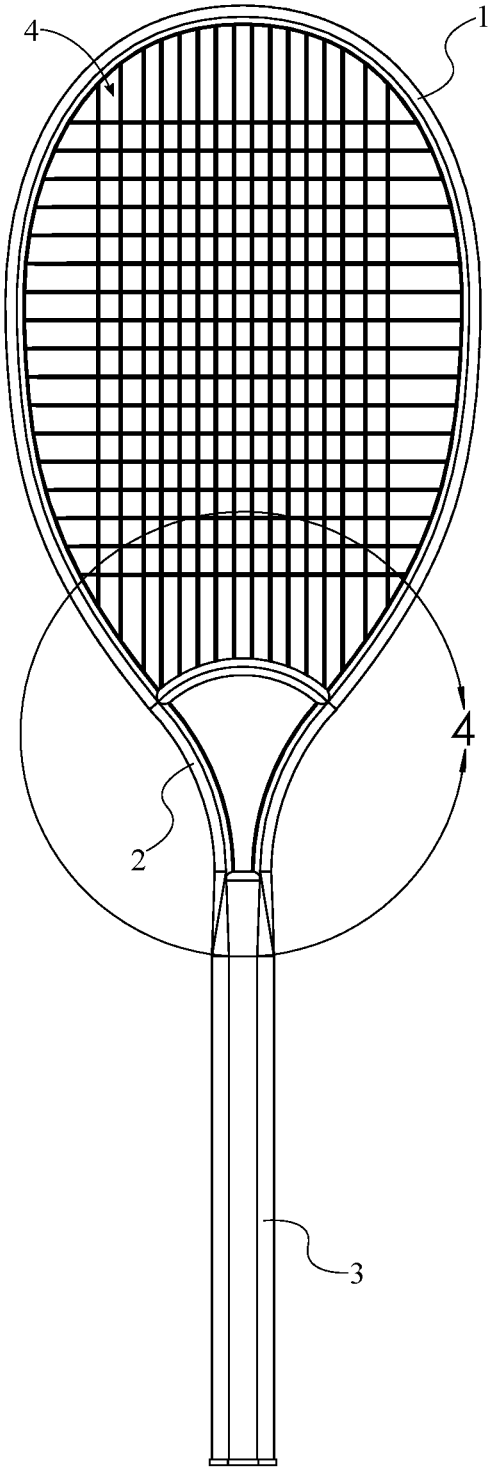
FIG. 2 is a front view of the present invention.

The present invention is a tennis racket with a more-responsive string configuration, which allows a user to better control how hard and what direction to hit a tennis ball. The present invention is able to add spin and power in a controlled manner as the tennis ball makes contact with the present invention. Thus, the present invention comprises a closed-shape beam 1, a throat 2, an elongated handle 3, and a plurality of lines 4, which are shown in FIGS. 1 and 2. The elongated handle 3 allows the user to properly grasp and swing the present invention. The plurality of lines 4 allows the present invention to make contact with the tennis ball and to redirect the tennis ball with a direction and a power in accordance to the user's preference. The closed-shape beam 1 is used to tension and hold the plurality of lines 4 in place on the present invention. The closed-shape beam 1 is preferably configured into an elliptical shape or a circular shape. The throat 2 acts as a structural bridge between the elongated handle 3 and the closed-shape beam 1.

The general configuration of the aforementioned components allows the present invention to effectively add spin and power in a controlled manner as the present invention hits a tennis ball. The elongated handle 3 is connected adjacent to the throat 2, and closed-shape beam 1 is connected adjacent to the throat 2, opposite to the elongated handle 3. This arrangement between the elongated handle 3, the throat 2, and the closed-shape beam 1 allows the user to properly grasp the present invention and to accurately hit a tennis ball. In addition, each of the plurality of lines 4 is tensionably mounted within the closed-shape beam 1, which allows the plurality of lines 4 to elastically contort as a tennis ball makes contact with the plurality of lines 4 and then allows the plurality of lines 4 to elastically retract as the tennis ball rebounds off of the plurality of lines 4. The plurality of lines 4 is also arranged into an interwoven grid configuration so that the present invention has an adequately-sized contact area for a tennis ball.

Figure 3:
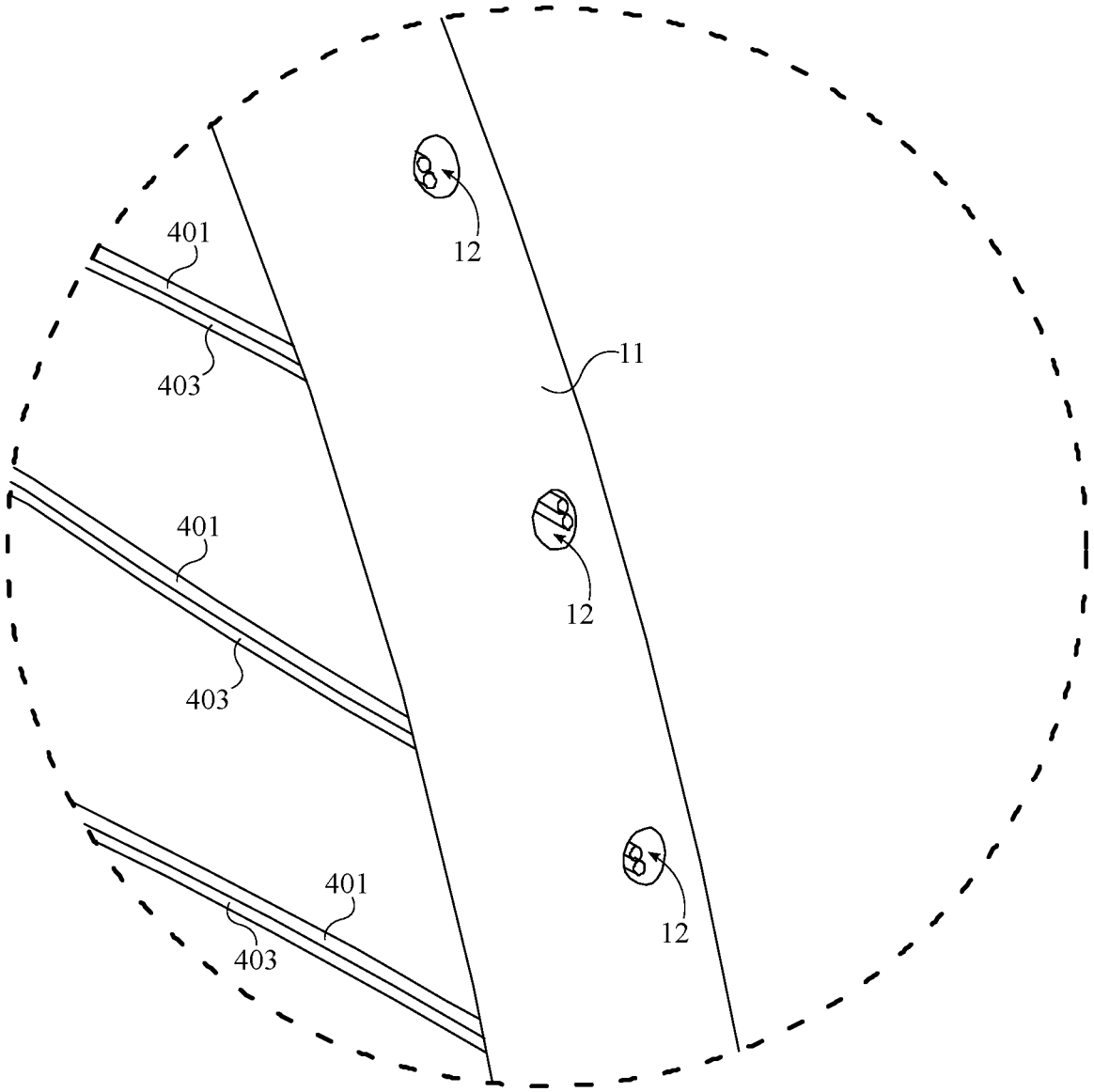
FIG. 3 is a detail view taken about circle 3 in FIG. 1.
Figure 5:
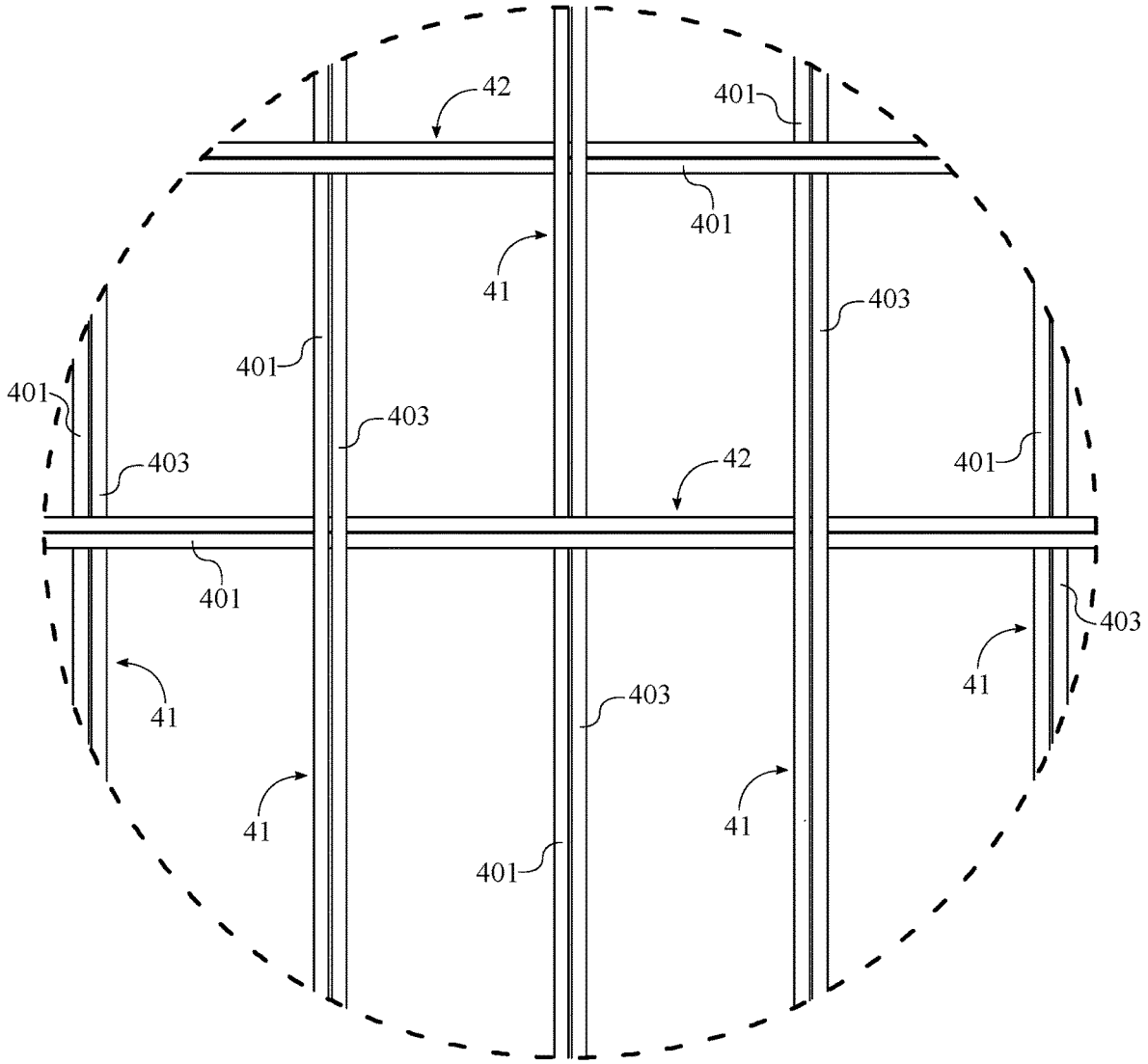
FIG. 5 is a detail view taken about circle 5 in FIG. 4.

In order to improve the ball-handling responsiveness of the present invention, each of the plurality of lines 4 comprises a first string 401 and a second string 403, which are shown in FIGS. 3 and 5. The first string 401 and the second string 403 lay against each other to form each of the plurality of lines 4. More specifically, a lateral surface 402 of the first string 401 is positioned tangent to a lateral surface 404 of the second string 403. The first string 401 and the second string 403 separate from each other as a tennis ball makes contact with the plurality of lines 4, which creates a more responsive recoil by the first string 401 and the second string 403 as the first string 401 and the second string 403 come back together in order to rebound the tennis ball off of the plurality of lines 4.

Figure 4:
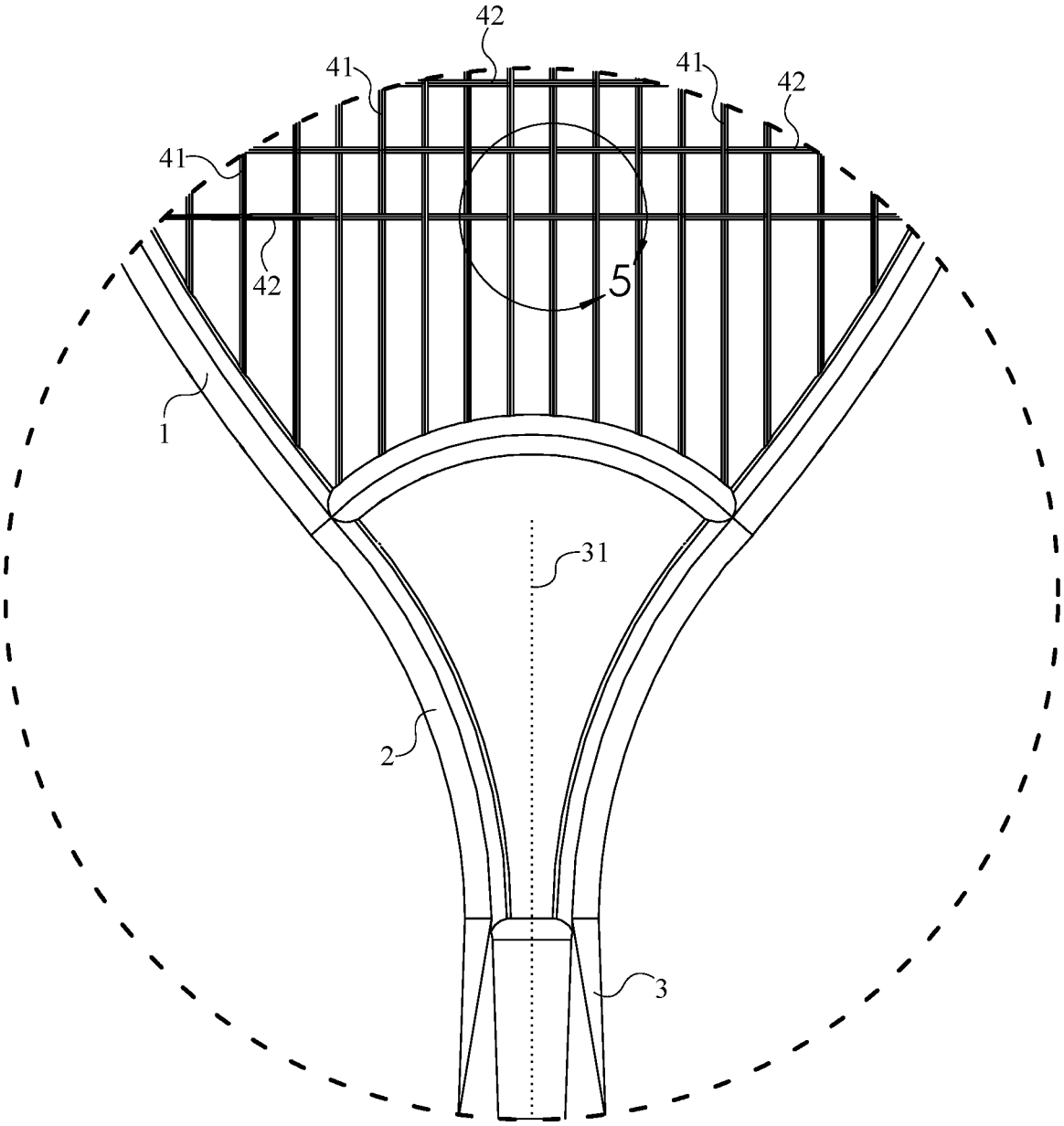
FIG. 4 is a detail view taken about circle 4 in FIG. 2.

As can be seen in FIGS. 4 and 5, the interwoven grid configuration provides the present invention with a properly-structured contact area for a tennis ball. More specifically, the plurality of lines 4 comprises a set of main lines 41 and a set of cross lines 42. Moreover, a longitudinal axis 31 centrally traverses along the elongated handle 3 and can be used to describe the orientation of the set of main lines 41 and the set of cross lines 42. The set of main lines 41 is distributed across the closed-shape beam 1 and is positioned parallel to the longitudinal axis 31 of the elongated handle 3. The set of cross lines 42 is also distributed across the closed-shape beam 1 and is positioned perpendicular to the longitudinal axis 31 of the elongated handle 3. The arrangement between the set of main lines 41 and the set of cross lines 42 allows the set of main lines 41 to be interwoven amongst the set of cross lines 42 in a crisscrossing pattern.

Figure 7:
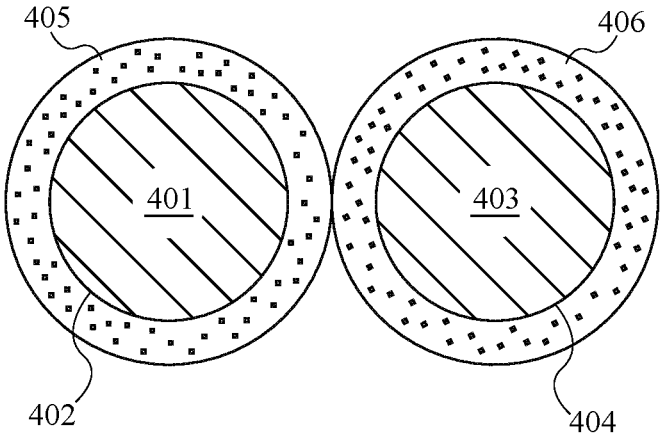
FIG. 7 is a schematic cross-sectional view illustrating a respective coating of bowstring lube wax for the first string and the second string.

As can be seen in FIG. 7, the first string 401 and the second string 403 for each of the plurality of lines 4 needs to be configured to prevent fraying because the plurality of lines 4 is used to continuously hit a tennis ball during the course of a game. Thus, each of the plurality of lines 4 may further comprise a first coating of bowstring lube wax 405 and a second coating of bowstring lube wax 406, which prolongs the usage life of the first string 401 and the second string 403. The first coating of bowstring lube wax 405 and the second coating of bowstring lube wax 406 is preferably composed of rosin. The first coating of bowstring lube wax 405 is superimposed onto the lateral surface of the first string 401, and the second coating of bowstring lube wax 406 is superimposed onto the lateral surface of the second string 403, which allows the first coating of bowstring lube wax 405 and the second coating bowstring lube wax to respectively maintain a necessary amount of tackiness on the first string 401 and the second string 403 in order to reduce the amount of fraying for the first string 401 and the second string 403.

The physical properties of the first string 401 and the second string 403 also impact the ball-handling responsiveness of the plurality of lines 4. In one preferred embodiment, the first string 401 and the second string 403 each are a 150-pound fishing line, which provides the plurality of lines 4 with a more-forgiving, duller ball-handling responsiveness. In another preferred embodiment, the first string 401 and the second string 403 each are a 300-pound fishing line, which provides the plurality of lines 4 with a less-forgiving, sharper ball-handling responsiveness. In both preferred embodiments, the first string 401 and the second string 403 are each made of braided strands of ultra-high-molecular-weight polyethylene fiber, which provide the first string 401 and the second string 403 with a high degree of structural integrity. The first string 401 and the second string 403 can be made of some other types of materials, which include, but is not limited to, super 8-strands braided 300-pound 1.00 mm fishing line dyneema, Saratoga shadow strike 6-strand braided 150-pound 0.68 mm fishing line dyneema, spectra extreme 4-strand braided 100-pound 0.55 mm fishing line dyneema, 10-pound fishing line monofilament, and a single fiber of plastic.

Figure 6:
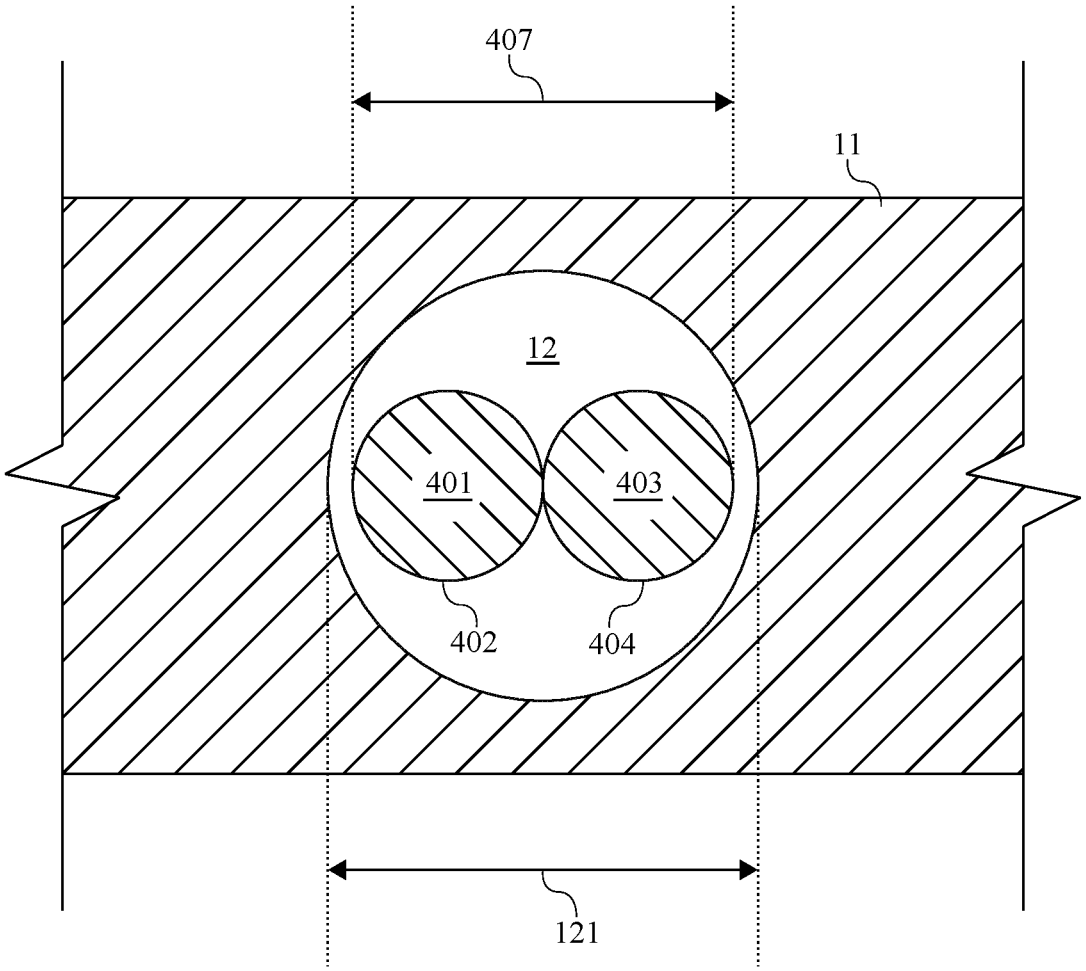
FIG. 6 is a schematic cross-sectional view illustrating a line-receiving hole, a first string, and a second string for the present invention.

The closed-shape beam 1 needs to be configured to accommodate both the first string 401 and the second string 403 for each of the plurality of lines 4. Thus, the closed-shape beam 1 may comprise a beam body 11 and a plurality of line-receiving holes 12, which are shown in FIGS. 3 and 6. The plurality of line-receiving holes 12 is used to mount, tension, and direct the plurality of lines 4 through the beam body 11, which is the structural body of the closed-shape beam 1. Each of the plurality of line-receiving holes 12 traverses through the beam body 11 so that each of the plurality of lines 4 can be woven through and properly secured onto the beam body 11. Moreover, the plurality of line-receiving holes 12 is distributed around the beam body 11 so that the plurality of lines 4 can be woven into a large-enough contact area for a tennis ball. Each of the plurality of lines 4 is also positioned through a corresponding hole from the plurality of plurality of line-receiving holes 12, which allows the plurality of line-receiving holes 12 to guide and tension the plurality of lines 4 through the beam body 11. In addition, a cross-sectional diameter 121 of the corresponding hole is larger than a combined cross-sectional diameter 407 of the first string 401 and the second string 403, which allows each of the plurality of line-receiving holes 12 to adequately accommodate the larger combined width of the first string 401 and the second string 403 for each of the plurality of lines 4.

The plurality of lines 4 can be configured by folding a single continuous line in half and weaving the folded continuous line through the plurality of line-receiving holes 12. In one example, the 300-pound fishing line is 46 feet long, and its ends are tied together. In another example, a 150-pound fishing line is 46 feet long, and its ends are tied together. The 150-pound fishing line is now only 23 feet long. In another example, a 100-pound fishing line is 129 feet long. The fishing line is made into two different lengths: one length is 86 feet and the other length is 43 feet. The 86 feet long fishing line has its ends are tied together, and the 43 feet long fishing line is tied together with the other fishing line in order to make one fishing line. This results in a 43 feet long fishing line. In conclusion, these three examples of fishing lines illustrate different ways to make one line that is 43 feet long. The fishing lines are tied together by using the 10-pound fishing line. The 10-pound fishing lines are only used to tie the heavier fishing lines together.

Although the invention has been explained in relation to its preferred embodiment, it is to be understood that many other possible modifications and variations can be made without departing from the spirit and scope of the invention as hereinafter claimed.

What is claimed is:

1. A tennis racket constructed to include a more-responsive string configuration by the method comprising:

providing a closed-shape beam having a body with a plurality of line receiving holes extending through the beam body, the line receiving holes being distributed around the beam body;

an elongated handle having a longitudinal axis;

a throat positioned between the closed-shape beam and the elongated handle, the throat connected to the closed-shape beam and the elongated handle to form a bridge therebetween;

providing a plurality of lines including a first tennis string and a second tennis string, defining the first and second tennis strings by opposite free end portions with a preselected length;

positioning the first and second tennis strings to lay against each other prior to positioning the first and second tennis strings for weaving back and forth across the beam body as the strings pass simultaneously through the line receiving holes;

the first tennis string and the second tennis string each having a lateral surface;

positioning the first tennis string being alongside and disconnected from the second tennis string prior to positioning the first and second tennis strings in the line receiving holes, positioning the lateral surface of the first tennis string tangent to and separate from the lateral surface of the second tennis string and thereafter passing the tennis strings simultaneously together through the line receiving holes;

passing a first set of the plurality of lines including the disconnected first and second tennis strings positioned with the lateral surfaces thereof tangent to and separate from each other through the holes in the beam body forming a main grid of lines positioned parallel to the longitudinal axis of the elongated handle;

passing a second set of the plurality of lines including the disconnected first and second tennis strings positioned with the lateral surfaces thereof tangent to and separate from each other through the holes in the beam body forming a cross grid of lines positioned perpendicular to the longitudinal axis of the elongated handle, and interweaving the main grid of lines and the cross grid of lines in a crisscrossing pattern forming a contact area for a tennis ball where the first and second set of the tennis strings are guided and tensioned by the lines passing through the holes in the beam body.

2. The tennis racket constructed to include a more-responsive string configuration by the method as claimed in claim 1 comprising:

the longitudinal axis centrally traversing along the elongated handle;

the main grid of lines being distributed across the closed-shape beam;

the main grid of lines being positioned parallel to the longitudinal axis;

the cross grid of lines being distributed across the elongated handle;

the cross grid of lines being positioned perpendicular to the longitudinal axis; and the main grid of lines being interwoven amongst the cross grid of lines.

3. The tennis racket constructed to include a more-responsive string configuration by the method as claimed in claim 1, wherein the first tennis string and the second string each are a 150-pound fishing line.

4. The tennis racket constructed to include a more-responsive string configuration by the method as claimed in claim 1, wherein the first tennis string and the second tennis string each are a 300-pound fishing line.

5. The tennis racket constructed to include a more-responsive configuration as by the method claimed in claim 1, wherein the first tennis string is made of braided strands of ultra-high-molecular-weight polyethylene fiber.

6. The tennis racket constructed to include a more-responsive string configuration by the method as claimed in claim 1, wherein the second tennis string is made of braided strands of ultra-high molecular weight polyethylene fiber.

7. The tennis racket constructed to include a more-responsive string configuration by the method as claimed in claim 1 comprising:

each of the plurality of lines extending through the plurality of line receiving holes; and a cross-sectional diameter of the corresponding hole being larger than a combined cross-sectional diameter of the first tennis string and the second tennis string positioned in tangent relationship.

8. A tennis racket constructed to include a more-responsive string configuration by the method comprising:

providing a closed-shape beam having a body with a plurality of line receiving holes extending through the beam, the holes being distributed around the beam body;

an elongated handle;

a throat positioned between the closed-shape beam and the elongated handle, the throat connected to the closed-shape beam and the elongated handle to form a bridge therebetween;

providing a plurality of lines including a first tennis string, a second tennis string, a first coating of bowstring lube wax; and a second coating of bowstring lube wax;

positioning the first and second tennis strings to lay against each other prior to positioning the first and second tennis strings in the line receiving holes for weaving back and forth across the beam body as the strings pass simultaneously through the line receiving holes;

disconnecting the first tennis string and the second tennis string from one another and having a preselected length defined by opposite free end portions including a lateral surface, positioning the lateral surfaces of the first and second tennis strings in separable and tangent relationship for movement of the lateral surfaces into and out of contact;

passing the disconnected first and second tennis strings simultaneously through the line receiving holes and tensioning the disconnected tennis strings to form an interwoven grid configuration within the closed-shape beam;

superimposing the first coating of bowstring lube wax onto the lateral surface of the first tennis string;

superimposing the second coating of bowstring lube wax onto the lateral surface of the second tennis string; and the first tennis string and the second tennis string having a preselected pound test fishing line.

9. The tennis racket constructed to include a more-responsive string configuration by the method as claimed in claim 8 comprising:

the plurality of lines comprising a set of main lines and a set of cross lines;

a longitudinal axis centrally traversing along the elongated handle;

distributing the set of main lines across the closed-shape beam;

positioning the set of main lines parallel to the longitudinal axis;

distributing the set of cross lines across the closed-shape beam;

positioning the set of cross lines perpendicular to the longitudinal axis; and interweaving the set of main lines amongst the set of cross lines.

10. The tennis racket constructed to include a more-responsive string configuration by the method as claimed in claim 8, wherein the first tennis string is made of braided strands of ultra-high molecular-weight polyethylene fiber.

11. The tennis racket constructed to include a more-responsive string configuration by the method as claimed in claim 8, wherein the second tennis string is made of braided strands of ultra-high-molecular-weight polyethylene fiber.

12. The tennis racket constructed to include a more-responsive string configuration as claimed in claim 8 comprising:

each line receiving hole having a cross-sectional diameter larger than a combined cross-section diameter of the tangent relationship of the first tennis string and the second tennis string.

13. A tennis racket constructed to include a more-responsive string configuration by the method comprising:

providing a closed-shape beam having a body with a plurality of line receiving holes extending through the beam, the line receiving holes being distributed around the beam body;

an elongated handle;

a throat positioned between the closed-shape beam and the elongated handle, the throat connected to the closed-shape beam and the elongated handle to form a bridge therebetween;

providing a plurality of lines comprising a first tennis string, a second tennis string, a first coating of bowstring lube wax, and a second coating of bowstring lube wax;

positioning the first and second tennis strings to lay against each other prior to positioning the first and second tennis strings in the line receiving holes for weaving back and forth across the beam body as the strings pass simultaneously through the line receiving holes;

disconnecting the first tennis string and the second tennis string from one another and having a preselected length defined by opposite free end portions including a lateral surface, positioning the lateral surfaces of the first and second tennis strings in separable and tangent relationship for movement of the lateral surfaces into and out of contact;

passing the first and second tennis strings simultaneously through the line receiving holes and tensioning the tennis strings to form an interwoven grid configuration within the closed-shape beam;

superimposing the first coating of bowstring lube wax onto the lateral surface of the first tennis string;

superimposing the second coating of bowstring lube wax onto the lateral surface of the second tennis string;

the first coating of bowstring lube wax and the second coating of bowstring lube wax each comprising a rosin material; and selecting the first tennis string and the second tennis string from fishing line having a pound test in the range between about 150 pound test to 300 pound test.

14. The tennis racket constructed to include a more-responsive string configuration by the method as claimed in claim 13 comprising:

forming a main grid of lines and a cross grid of lines;

a longitudinal axis centrally traversing along the elongated handle;

distributing the main grid of lines across the closed-shape beam parallel to the longitudinal axis;

distributing the cross grid of lines across the closed-shape beam perpendicular to the longitudinal axis; and interweaving the main grid of lines amongst the cross grid of lines.

15. The tennis racket constructed to include a more-responsive string configuration by the method as claimed in claim 13 comprising:

each line receiving hole having a cross-sectional diameter larger than a combined cross-sectional diameter of the tangent relationship of the first tennis string and the second tennis string.

16. A method for stringing a tennis racket for a more-responsive string configuration comprising the steps of, providing a closed-shape beam having a body with a plurality of line receiving holes extending through the beam body and distributed around the beam body, the beam connected through a throat to an elongated handle, providing a plurality of tennis strings including a first tennis string and a second tennis string, each tennis string having a preselected length;

defining the length of each of the first and second tennis strings by opposite free end portions to separate the strings one from another, maintaining the free end portions of the first tennis string disconnected from the free end portions of the second tennis string, positioning the first tennis string and the second tennis string to lay against each other prior to positioning the first and second tennis strings in the line receiving holes where a lateral surface of the first tennis string is tangent to a lateral surface of the second tennis string, passing simultaneously together with the lateral surfaces in tangent relation a first set of the first and second tennis strings through the line receiving holes in the beam body, weaving the first set of the first and second tennis strings back and forth across the beam body to form a main grid of lines positioned parallel to a longitudinal axis of the elongated handle, thereafter passing simultaneously together with the lateral surfaces in tangent relation a second set of the first and second tennis strings through the line receiving holes in the beam body, weaving the second set of the first and second tennis strings back and forth across the beam body to form a cross grid of lines positioned perpendicular to the longitudinal axis of the elongated handle, interweaving the main grid of lines and the cross grid of lines in a crisscrossing pattern to form a contact area for receiving a tennis ball, and tensioning the first and second set of the tennis strings as the disconnected strings pass simultaneously together through the line receiving holes in the beam body.

17. The method as set forth in claim 16 which includes, spreading apart the first tennis string and the second tennis string from each other in the first and second sets of tennis strings as a tennis ball makes contact with the plurality of strings, and creating a recoil of the first tennis string and the second tennis string back together as the tennis ball rebounds off of the tennis strings.

18. The method as set forth in claim 16 which includes, reducing the amount of fraying of the first tennis string and the second tennis string in the first and second sets of tennis strings by coating the tangent lateral surfaces of the first and second tennis strings with a coating of bowstring lube wax, and allowing the coating of bowstring lube wax to maintain a tackiness on the first and second tennis strings.

19. The method as set forth in claim 18 which includes, coating the tangent lateral surfaces of the first and second tennis strings with a bowstring lube wax of rosin.

20. The method as set forth in claim 16 which includes, using the plurality of tennis strings to form the main grid of lines and the cross grid of lines made of braided strands of ultra-high molecular weight polyethylene fiber selected from the group consisting of 150-pound fishing line and 300-pound fishing line.

* * * * *